United States Patent [19]

Wehle et al.

[11] 4,299,725

[45] Nov. 10, 1981

[54] AQUEOUS MEDIA OF DECREASED CORROSIVENESS FOR IRON-CONTAINING METALS

[75] Inventors: Volker Wehle, Hilden; Wolfgang Rupilius, Düsseldorf; Jürgen Reiffert, Oberhausen; Gabriele Rogall, Moers, all of Fed. Rep. of Germany

[73] Assignees: Henkel Kommanditgesellschaft auf Aktien, Dusseldorf-Holthausen; Deutsche Gold- und Silber Scheideanstalt vormals Roessler, Frankfurt am Main, both of Fed. Rep. of Germany

[21] Appl. No.: 885,320

[22] Filed: Mar. 10, 1978

Related U.S. Application Data

[63] Continuation of Ser. No. 683,515, May 5, 1976, abandoned.

[30] Foreign Application Priority Data

May 7, 1975 [DE] Fed. Rep. of Germany ..... 2520265

[51] Int. Cl.[3] ..... C09K 3/00

[52] U.S. Cl. ..... 252/389 A; 252/392; 252/389 R; 422/15; 422/19; 106/14.05; 106/14.12; 106/14.15

[58] Field of Search ..... 252/392, 387, 389 A, 252/389 R, 180, 181; 422/15, 12, 13, 19; 106/14.05, 14.15, 14.12; 210/58–60; 260/584 R, 585 R, 585 B

[56] References Cited

U.S. PATENT DOCUMENTS

| | | | |
|---|---|---|---|
| 3,398,198 | 8/1968 | Kersnar et al. | 260/584 |
| 3,668,094 | 6/1972 | Hatch | 252/389 A |
| 3,668,138 | 6/1972 | Hoover et al. | 252/389 A |

*Primary Examiner*—J. L. Barr

*Attorney, Agent, or Firm*—Hammond & Littell, Weissenberger and Muserlian

[57] ABSTRACT

Aqueous media having a dissolved content of a small amount, (less than 100 p.p.m.) of a mixture of aminoalkanols of the formula:

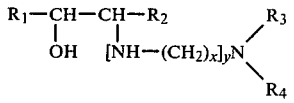

wherein $R_1$ and $R_2$ each represent H and $C_{1-18}$ unbranched alkyl substituents (the sum of the carbon atoms in $R_1$ and $R_2$ being 9 to 18), $R_3$ and $R_4$ each represent H, $C_{1-4}$ alkyl and $C_{2-4}$ hydroxyalkyl substituents, x represents 2 to 6, and y represents 0 to 1, the

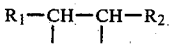

units in the aminoalkanols being of at least two different chain lengths in the range of 11 to 20 carbon atoms, possess decreased tendency to corrode iron-containing metals including steel. The mixtures are also useful in salt form. The efficiency of the mixture is improved by various additives which act synergistically therewith.

10 Claims, No Drawings

AQUEOUS MEDIA OF DECREASED CORROSIVENESS FOR IRON-CONTAINING METALS

This is a continuation of Ser. No. 683,515, filed May 5, 1976, and now abandoned.

FIELD OF THE INVENTION

The present invention relates to aqueous media of decreased corrosiveness towards steel and other corrodible metals. The invention includes industrial water systems, coolant water systems, steam generating systems, and heating systems of decreased corrosiveness, and includes methods for the preparation of such media.

BACKGROUND OF THE INVENTION

The treatment of metallic water-circulating apparatus such as those employed in steam generating plants, heating systems, cooling water circuits and waterpipe systems to protect them against the corrosive action of water has been an industrial practice for a long time. The treatment is directed primarily towards the protection of the base metals used for the fabrication of such apparatus, chiefly steel, brass, aluminum, zinc and galvanized steel. Among the agents used for the purpose are the long-chained aliphatic amines described in U.S. Pat. No. 2,460,259. But with these amines it is only possible to obtain a sufficient corrosion-preventing effect when they are present in relatively high concentrations, which raises a number of problems in their application. The aliphatic amines, particularly the long-chain fatty amines, are solids at room temperature and must be brought into a liquid, easily dilutable form. The very poor water-solubility of the corrosion-inhibiting aliphatic amines requires in practice the production of dispersions with additional dispersing aids (U.S. Pat. No. 3,088,796), but both the dispersing aids and also the fatty amines themselves can cause considerable foaming in circulating systems.

OBJECTS OF THE INVENTION

One object of the invention is to provide aqueous media which are of less comparative corrosiveness towards iron-containing metals than the aqueous media presently in industrial use, which possess about the same specific heat and boiling point as said presently used media, and which can be readily prepared from inexpensive raw materials.

Another object of the invention is to provide such media wherein the anti-corrosion agent is present in no more than virtual trace amount.

THE INVENTION

It was found that the foregoing objects are attained and previous disadvantages overcome by aqueous media having a very small content (in the range of 0.1 to 100 parts per million by weight) of an aminoalkanol material selected from the group consisting of (1) mixtures of vicinal aminoalkanols having the formula:

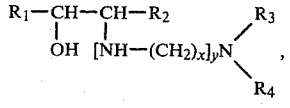

wherein $R_1$ and $R_2$ each represent a substituent selected from the group consisting of H and unbranched alkyl having 1 to 18 carbon atoms and the sum of the carbon atoms in $R_1$ and $R_2$ is from 9 to 18 inclusive, $R_3$ and $R_4$ each represent a substituent selected from the group consisting of H, $C_{1-4}$ alkyl and $C_{2-4}$ hydroxyalkyl; and x represents a value from 2 to 6 and y represents a value from 0 to 1 inclusive; the

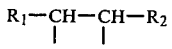

units in the aminoalkanols of said mixture being of at least two different chain lengths in the range from 11 to 20 carbon atoms, and (2) salts of said aminoalkanols.

A variety of commercially available mixtures of monoolefins are available as starting materials for the preparation of aminoalkanol mixtures which are suitable for use in the invention.

Suitable mixtures of monoolefins are obtained by dehydrogenation (catalytically or by chlorination followed by dehydrochlorination) of linear paraffins of 11 to 20 carbon atoms followed by removal of the monoolefin content of the reaction product (by distillation or selective extraction as may be preferred). In the monoolefins the double bonds are substantially non-terminal and are distributed statistically (i.e., randomly) along the "backbone"

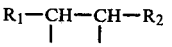

chain. Of these monoolefin mixtures, two fractions with the following chain length distributions are preferred:

| Fraction | Olefin Fractions Used % by Wt. |
|---|---|
| (a) $C_{11}$–$C_{14}$ fraction | |
| $C_{11}$ | 22 |
| $C_{12}$ | 30 |
| $C_{13}$ | 26 |
| $C_{14}$ | 22 |
| (b) $C_{15}$–$C_{18}$ fraction | |
| $C_{15}$ | 26 |
| $C_{16}$ | 35 |
| $C_{17}$ | 31 |
| $C_{18}$ | 6 |

On the other hand, it is also possible to use olefin mixtures which are prepared by aluminochemical methods and which have unbranched alkyl chains with 12 to 20 carbon atoms. These mixtures have a high (i.e., more than 50%) proportion of terminal unsaturation, and commercial products are suitable which have the chain length distributions shown below:

| Fraction | Olefin Fractions Used | % by Wt. |
|---|---|---|
| (c) $C_{12}$–$C_{14}$ fraction | | |
| $C_{12}$ | Terminal | 55 |
| $C_{14}$ | " | 31 |
| $C_{12}$ | Non-Term. | 5 |
| $C_{14}$ | " | 8 |
| (d) $C_{14}$–$C_{16}$ fraction | | |
| $C_{14}$ | Terminal | 53 |
| $C_{16}$ | " | 28 |
| $C_{14}$ | Non-Term. | 7 |
| $C_{16}$ | " | 11 |

-continued

| Fraction | Olefin Fractions Used | % by Wt. |
|---|---|---|
| | (c) $C_{16}$-$C_{18}$ fraction | |
| $C_{16}$ | Terminal | 35 |
| $C_{18}$ | " | 23 |
| $C_{20}$ | " | 2 |
| $C_{16}$ | Non-Term. | 11 |
| $C_{18}$ | " | 21 |
| $C_{20}$ | " | 5 |

But it is also possible to use olefin mixtures which contain saturated hydrocarbons when they are obtained with the olefin mixtures.

By means of known methods, e.g. reaction with peracids like peracetic acid, we obtain the epoxidized olefin mixtures from which aminoalkanol mixtures suitable for use in the present invention can be obtained by reaction with amines like ammonia, ethylenediamine, propylenediamine, tetramethylenediamine, monoethylenediamine, diethanolamine and N-ethanolethylene diamine.

Aqueous media containing only trace amounts of the above-described aminoalkanol mixtures have surprisingly low tendency to corrode. Because of their low solidification points and good water-solubility, the mixtures can be readily formed into aqueous solutions of stock strength which can be dosed directly into the aqueous media to be benefited.

A particularly suitable aminoalkanol mixture is the reaction product of an epoxidized $C_{15}$-$C_{18}$ monoolefin mixture with propylenediamine. The mixture has the formula:

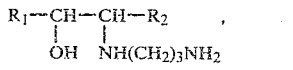

wherein the grouping $R_1$—CH—CH—$R_2$ contains 15 to 18 carbon atoms.

Another advantage of the invention is that handling the aminoalkanol mixtures is more pleasant and is considerably safer than the handling of crude fatty amines hereto used because of their mild odor and their low tendency to irritate the skin and eyes.

To substantially inhibit corrosion in aqueous systems it suffices if the amount of the mixture of aminoalkanols described above is 0.1 to 100 parts by weight, preferably 1-50 parts by weight per million parts by weight of the aqueous medium.

A synergistic increase in the corrosion-inhibiting action of the aminoalkanol mixtures according to the invention occurs when other corrosion-inhibiting polyvalent ions like zinc ions are present. Amounts in the range of 0.1 to 10 parts per million give good results.

Beyond that it was found that sequestering phosphonic acids and/or their salts are of advantage. Effective phosphonic acids, for example, are hydroxyethanediphosphonic acid, aminotrimethylene-phosphonic acid and 2-phosphonobutane-1, 2, 4-tricarboxylic acid as well as mixtures thereof. Amounts of these agents in the range of 0.3 to 30 parts per million give good results.

Best results are obtained when the aqueous medium contains both zinc ions and a phosphonic acid sequestering agent.

The aqueous media of the invention may advantageously contain biocidal substances like glutaraldehyde, glyoxal, sodium pentachlorophenol or alkyl oligamides, preferably the reaction product of dodecyl propylenediamine and ε-caprolactam in a molar ratio of 1:2.

The invention is described below more fully in the examples. These examples illustrate the invention and are not to be construed in limitation thereof.

EXAMPLES

The following aminoalkanol mixtures, listed in Table 1, were prepared by reacting epoxidized olefin mixtures with amines, and can be present in the aqueous media of the present invention. The epoxidized olefin mixtures in the table designate mixtures which correspond to the composition indicated in the description.

Testing Method

Aqueous solutions of aminoalkanol mixtures described above were tested for their corrosiveness to iron-containing metal as follows.

In each instance a carefully cleaned steel test plate (75×12×1.5 mm.) is immersed at room temperature for 24 hours in a 1-liter glass beaker filled with 1 liter of Düsseldorf (Germany) city water and the substance to be tested is added thereto. The tests are run in groups of 10, and are all stirred at 100 r.p.m. Subsequently the plates are cleared of corrosion products, and the weights lost by the plates are determined. The corrosion inhibiting action of the products are determined from the mean values of three tests each, as a percentage of the weight lost by the blank.

TABLE 1

| Aminoalkanol Designation | | | Sol[1] Pt. °C. | Start. Olef. Mixt. | Amine Used |
|---|---|---|---|---|---|
| N—T | 14 | A | −5 | $C_{11}$-$C_{14}$ | Ammonia |
| N—T | 14 | AP | −37 | $C_{11}$-$C_{14}$ | Propylenediamine |
| N—T | 14 | DM | −66 | $C_{11}$-$C_{14}$ | Dimethylamine |
| N—T | 14 | AE | 14 | $C_{11}$-$C_{14}$ | Ethylenediamine |
| N—T | 14 | HE—AE | 2 | $C_{11}$-$C_{14}$ | N-Ethanolethylenediamine |
| N—T | 14 | DHE | −17 | $C_{11}$-$C_{14}$ | Diethanolamine |
| N—T | 14 | HE | −23 | $C_{11}$-$C_{14}$ | Monoethanolamine |
| N—T | 58 | A | 16 | $C_{15}$-$C_{18}$ | Ammonia |
| N—T | 58 | AE | 18 | $C_{15}$-$C_{18}$ | Ethylenediamine |
| N—T | 58 | AP | −28 | $C_{15}$-$C_{18}$ | Propylenediamine |
| N—T | 58 | AT | | $C_{15}$-$C_{18}$ | Tetramethylenediamine |
| N—T | 58 | HE | −17 | $C_{15}$-$C_{18}$ | Monethanolamine |
| N—T | 58 | DHE | −21 | $C_{15}$-$C_{18}$ | Diethanolamine |
| N—T | 58 | DM | −34 | $C_{15}$-$C_{18}$ | Dimethylamine |
| N—T | 58 | AE | 18 | $C_{15}$-$C_{18}$ | Ethylenediamine |
| N—T | 58 | HE—AE | 2 | $C_{15}$-$C_{18}$ | N-Ethanolethylenediamine |
| T | 24 | M | 49 | $C_{12}$-$C_{14}$ | Methylamine |
| T | 24 | E | 53 | $C_{12}$-$C_{14}$ | Ethylamine |
| T | 24 | DM | −25 | $C_{12}$-$C_{14}$ | Dimethylamine |
| T | 24 | AE | 47 | $C_{12}$-$C_{14}$ | Ethylenediamine |
| T | 24 | AP | 50 | $C_{12}$-$C_{14}$ | Propylenediamine |
| T | 24 | DHE | −10 | $C_{12}$-$C_{14}$ | Diethanolamine |
| T | 46 | AP | 72 | $C_{14}$-$C_{16}$ | Propylenediamine |
| T | 46 | DHE | 24 | $C_{14}$-$C_{16}$ | Diethanolamine |
| T | 46 | DM | −1 | $C_{14}C_{16}$ | Dimethylamine |
| T | 46 | AE | 65 | $C_{14}$-$C_{16}$ | Ethylenediamine |
| T | 46 | AE | 66 | $C_{16}$-$C_{18}$ | Ethylenediamine |
| T | 68 | AP | 71 | $C_{16}$-$C_{18}$ | Propylenediamine |
| T | 68 | DHE | 27 | $C_{16}$-$C_{18}$ | Diethanolamine |

[1] Solidification point.

The Düsseldorf city water used as the corrosive test medium had the following analysis:

| | |
|---|---|
| Total hardness | 16.5° German hardness |
| Carbonate hardness | 8.4° German hardness |
| Cl concentration | 165 mg./l. |
| pH | 7.4–8.2 |

EXAMPLE 1

The aminoalkanols were tested for their corrosion-inhibiting action by the method shown above. The aminoalkanols were added as 10% by weight aqueous solutions in each instance in amount sufficient to provide 10 p.p.m. of the aminoalkanol. No other material was added. The results are compiled in Table 2 in terms of percent of the corrosion of the blank.

TABLE 2

| Amino-Alkanol Used | Corrosion % of Blank |
|---|---|
| Blank | 100 |
| N—T 58 A | 68 |
| N—T 58 AE | 41 |
| N—T 58 AP | 26 |
| N—T 58 AT | 54 |
| N—T 58 HE | 74 |
| N—T 58 DHE | 75 |
| N—T 14 HE—AE | 55 |

All aminoalkanols showed a good corrosion inhibiting action. A particularly good corrosion-inhibiting action, where the corrosion was only 26% of the blank, was displayed by product N-T 58 AP, which was prepared by reacting a mixture of epoxidized $C_{15}$–$C_{18}$ monoolefins with propylenediamine.

EXAMPLE 2

The synergistic increase in the protective action afforded by an aminoalkanol corrosion inhibitor by zinc ions and hydroxyethane diphosphonic acid (HEDP) in combination is shown by the following test data.

| Composition of Inhibitor Solution | | | |
|---|---|---|---|
| Parts By Wt. | Name | Dose p.p.m. | Corrosion % of Blank |
| 6 | Zinc II ions | | |
| 4 | HEDP | 30 | 44 |
| 90 | Water | | |
| 6 | Zinc II ions | | |
| 4 | HEDP | 30 | 12 |
| 3 | N—T 58 AP | | |
| 87 | Water | | |

The table shows that the dissolved zinc ions synergistically assist or fortify the corrosion inhibitory effect of a mixture of aminoalkanols.

EXAMPLE 3

A combination of aminotrimethylenephosphonic acid and a biocidal substance based on glutaraldehyde and glyoxal was tested according to the above described method, compared to a combination which contained additionally an aminoalkanol mixture according to the invention.

| Composition of Inhibitor Solution | | | |
|---|---|---|---|
| Parts By Wt. | Name | Dose p.p.m. | Corrosion % of Blank |
| 40 | Biocide* | | |
| 10 | ATMP** | 100 | 165 |
| 50 | Water | | |
| 40 | Biocide* | | |
| 10 | ATMP** | 100 | 68 |
| 15 | N—T 58 AP*** | | |
| 35 | Water | | |

*glutaraldehyde and glyoxal.
**3-Amino-trimethylene-1-phosphonic acid.
***Prepared by epoxidizing a non-terminally unsaturated $C_{15}$–$C_{18}$ olefin with propylenediamine.

We claim:

1. An aqueous medium having an effective dissolved content in the range of 0.1 to 100 parts per million parts by weight as agent inhibiting the corrosiveness of said solution towards corrodible iron-containing metals, of an aminoalkanol material selected from the group consisting of mixtures of vicinal aminoalkanols having the formula:

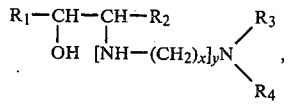

wherein $R_1$ and $R_2$ each represent a substituent selected from the group consisting of H and unbranched alkyl having from 1 to 18 carbon atoms and the sum of the carbon atoms in $R_1$ and $R_2$ is from 9 to 18, $R_3$ and $R_4$ each represent a substituent selected from the group consisting of H, $C_{1-4}$ alkyl and $C_{2-4}$ hydroxyalkyl; and x represents a value from 2 to 6 and y represents a value from 0 to 1 inclusive; the

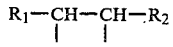

units in the aminoalkanols of said mixture being of at least two different chain lengths in the range from 11 to 20 carbon atoms and (2) water-soluble salts of said aminoalkanols.

2. An aqueous medium containing 1 to 50 parts per million parts by weight of said aminoalkanol mixture.

3. An aqueous medium according to claim 1 wherein the aminoalkanol mixture therein has the formula:

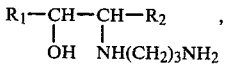

wherein the grouping 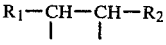

contains 15 to 18 carbon atoms.

4. An aqueous medium according to claim 1 having an effective dissolved content of divalent zinc ions as fortifying agent for said mixture of aminoalkanols.

5. An aqueous medium according to claim 1 having an effective dissolved content of a phosphonic acid sequestering agent as fortifying agent for said mixture of aminoalkanols.

6. An aqueous medium according to claim 5 wherein the phosphonic acid is hydroxyethanediphosphonic acid.

7. An aqueous medium according to claim 5 wherein the phosphonic acid is 3-amino-trimethylene-1-phosphonic acid.

8. An aqueous medium according to claim 1 having effective dissolved contents of a mixture of divalent zinc ions and a phosphonic sequestering agent as fortifying agent for said mixture of aminoalkanols.

9. An aqueous medium having an effective dissolved content, as agent inhibiting the corrosiveness of said solution towards corrodible iron-containing metals, of:

(A) 1 to 50 parts per million parts by weight of an aminoalkanol material selected from the group consisting of mixtures of vicinal aminoalkanols having the formula:

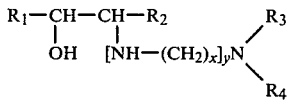

wherein $R_1$ and $R_2$ each represent a substituent selected from the group consisting of H and unbranched alkyl having from 1 to 18 carbon atoms and the sum of the carbon atoms in $R_1$ and $R_2$ is from 9 to 18, $R_3$ and $R_4$ each represent a substituent selected from the group consisting of H, $C_{1-4}$ alkyl and $C_{2-4}$ hydroxyalkyl, and X represents a value from 2 to 6 and y represents a value from 0 to 1 inclusive; the

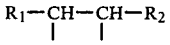

units in the aminoalkanols of said mixture being of at least two different chain lengths in the range from 11 to 20 carbon atoms; and water-soluble salts of said aminoalkanols;

(B) 0.1 to 10 parts per million parts by weight of divalent zinc ions; and (C) 0.3 to 30 parts per million parts by weight of a phosphonic acid sequestering agent.

10. An aqueous medium according to claim 9 wherein the aminoalkanol mixture therein has the formula:

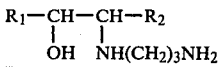

wherein the grouping 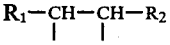 contains 15 to 18 carbon atoms.

* * * * *